United States Patent [19]

Glassman

[11] 4,164,083

[45] Aug. 14, 1979

[54] BELT-CONVEYOR IRONING MACHINE

[75] Inventor: Aaron Glassman, Scranton, Pa.

[73] Assignee: Pennsylvania Sewing Research Corp., Dunmore, Pa.

[21] Appl. No.: 858,094

[22] Filed: Dec. 7, 1977

[51] Int. Cl.[2] ..... D06F 69/02

[52] U.S. Cl. ..... 38/11; 38/34

[58] Field of Search ..... 38/7, 8, 9, 10, 11, 38/43, 2; 100/168

[56] References Cited

U.S. PATENT DOCUMENTS

| | | | |
|---|---|---|---|
| 1,629,071 | 5/1927 | Daly | 38/10 |
| 1,842,297 | 1/1932 | Silverstine et al. | 38/9 |
| 2,007,816 | 7/1935 | Simon | 38/10 |
| 2,782,536 | 2/1957 | Kroener et al. | 38/11 |
| 3,547,776 | 12/1970 | Curtis | 100/168 X |
| 3,668,786 | 6/1972 | Barny | 38/8 X |
| 3,727,437 | 4/1973 | Dokoupil | 38/10 X |

*Primary Examiner*—Louis Rimrodt

[57] ABSTRACT

Ironing machine comprises a belt conveyor positioned above a stationary ironing plate, means for maintaining the relative horizontal positions of the plate and the conveyor, and means for raising the conveyor from the plate. There is unobstructed access to one side of the machine when the conveyor is in the lowered, operating position.

3 Claims, 4 Drawing Figures

BELT-CONVEYOR IRONING MACHINE

BACKGROUND OF THE INVENTION

This invention relates to a novel ironing or fusing machine and particularly one that is adapted for fusing sheet-like parts together, such as the linings to garment parts.

It is known to iron or fuse together sheet-like parts in a machine comprising a belt conveyor and an ironing plate opposite a surface of the conveyor. The sheet-like parts are fed into the conveyor which draws the parts between the ironing plate and the conveyor belt and, at the same time, presses the parts against the ironing plate. A typical machine is described in U.S. Pat. No. 2,782,536 to J. L. Kroener et al, where the conveyor belt is above the ironing plate and is supported on both sides of the conveyor. With this support, the sheet-like parts are limited in size to less than the distance between the supports.

An object of this invention is to provide an ironing or fusing machine comprising a belt conveyor above an ironing plate wherein one side of the conveyor is not obstructed by a support during ironing.

A broader object is to provide an improved belt-conveyor ironing machine.

SUMMARY OF THE INVENTION

The novel ironing or fusing machine comprises a horizontal ironing plate, an endless belt conveyor supported above said ironing plate, and means on only one side of the conveyor for maintaining the conveyor and the ironing plate in substantially constant horizontal positions relative to one another. The machine includes also means for positioning, as by raising or spacing, the belt of the conveyor into and out of contact with the ironing plate, which spacing means leaves unobstructed access on the other side of the conveyor when the conveyor belt is in the in-contact position. This permits sheet-like parts which are much wider than the conveyor belt to be fed through the machine.

DETAILED DESCRIPTION OF THE PREFERRED EMBODIMENT

Figure 1:
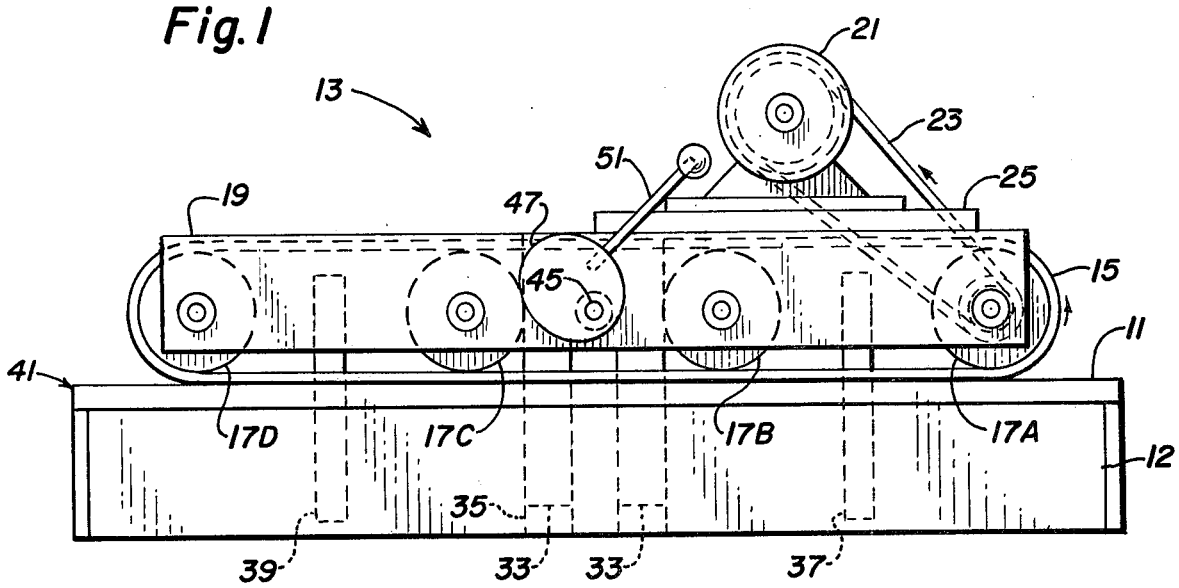
FIGS. 1, 2 and 3 are side, top and end views respectively of a preferred embodiment of the novel machine with the conveyor belt in the in-contact position.

FIGS. 1 to 4 show a preferred embodiment of the novel ironing machine comprising horizontal ironing or fusing plate 11 mounted on a base 12 and a belt conveyor 13 above the plate 11. The conveyor 13 comprises a continuous moving belt 15 which is supported on and guided by a set of rollers 17*a*, 17*b*, 17*c* and 17*d*, which are supported on a frame 19. The forward roller 17*a* is driven by an electric motor 21 through a drive belt 23. The motor 21 is supported on a base 25, which is attached to the frame 19.

During the normal ironing operation, the novel machine is supported on a work table large enough to accommodate the size and volume of sheet-like parts to be ironed. Also, the ironing plate 11 is heated electrically by means shown schematically in FIG. 3, including a resistance element 27 connected to a thermostatically controlled power source 29. In the lowered, in-contact position (FIG. 1), the conveyor is supported on the ironing plate 11 and the weight of the conveyor provides the force for pressing the sheet-like parts between the belt 15 and the ironing plate 11. Also, during operation, the horizontal positions of the ironing plate and the belt are maintained substantially constant relative to each other by a yoke 31 mounted on the frame 19 on one side of the conveyor. The yoke includes two legs 33 that extend downwardly around the crossbar of an H-shaped structure 35 attached to the one side of the frame 19. This arrangement permits vertical movement but resists both rotational and translational movement of the conveyor 13 with respect to the ironing plate 11. To further stabilize horizontal movement of the conveyor 13 with respect to the plate 11, a forward outrigger 37 and an after outrigger 39 attached to the one side of the frame 19 extend upwardly into loose contact with the one side of the frame 19. The outriggers 37 and 39 are located outward from the yoke and aid principally in resisting forces which would rotate the conveyor 13 with respect to the ironing plate 11.

During normal operation of the novel machine, the power source 29 is switched on energizing the resistance element 27 which maintains the ironing plate 11 in a desired temperature range by thermostatic control as is known in the art. The motor 21 is turned on which causes the drive belt and conveyor belt to operate in the direction shown by the arrows in FIGS. 1 and 4. Sheet or web material to be ironed or fused together is fed into the input end 41 of the machine between the belt 15 and the plate 11 where it passes successively under the rollers 17*d*, 17*c*, 17*b* and 17*a* and then out of the output end 43 of the machine. Because of the mounting of the conveyor frame 19 to the plate 11, the conveyor 13 can move in the vertical direction (normal to the plate surface) according to the thickness of the material being fed through the machine. This maintains a constant pressure on the material passing through regardless of thickness.

Figure 2:
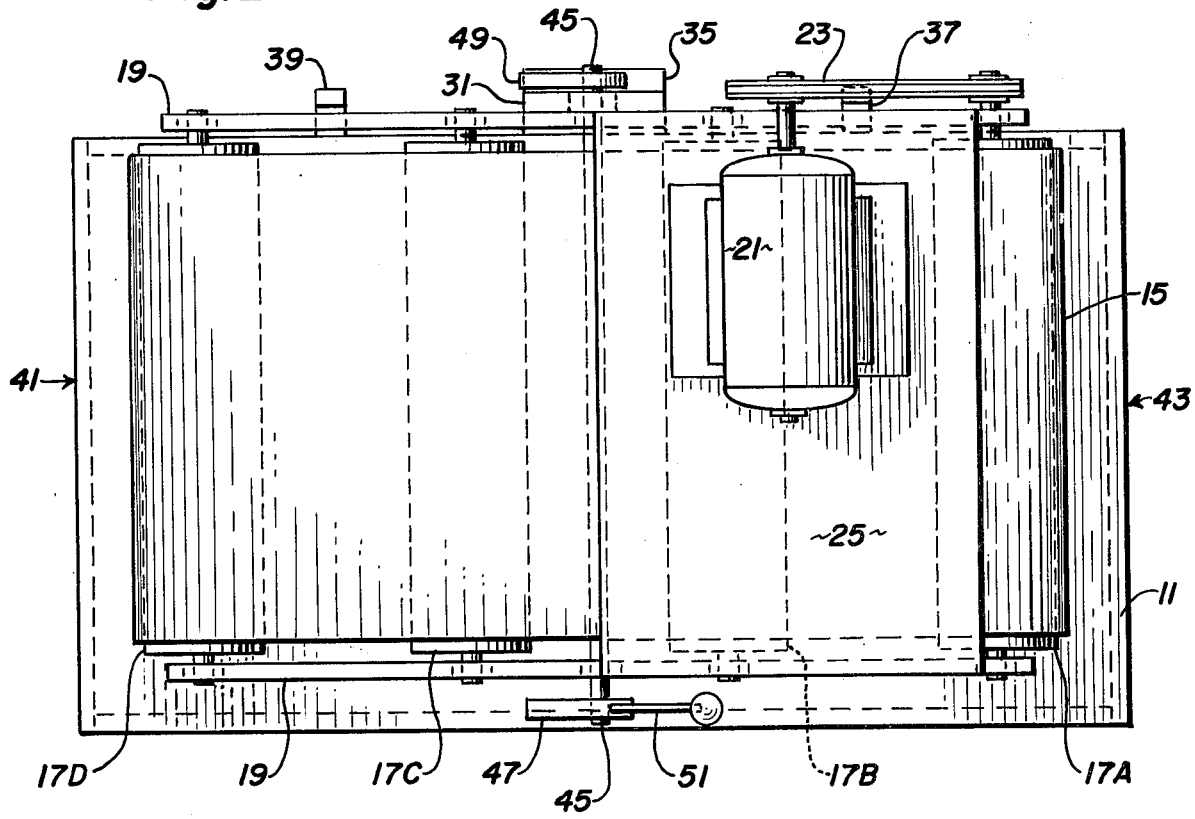
Figure 3:
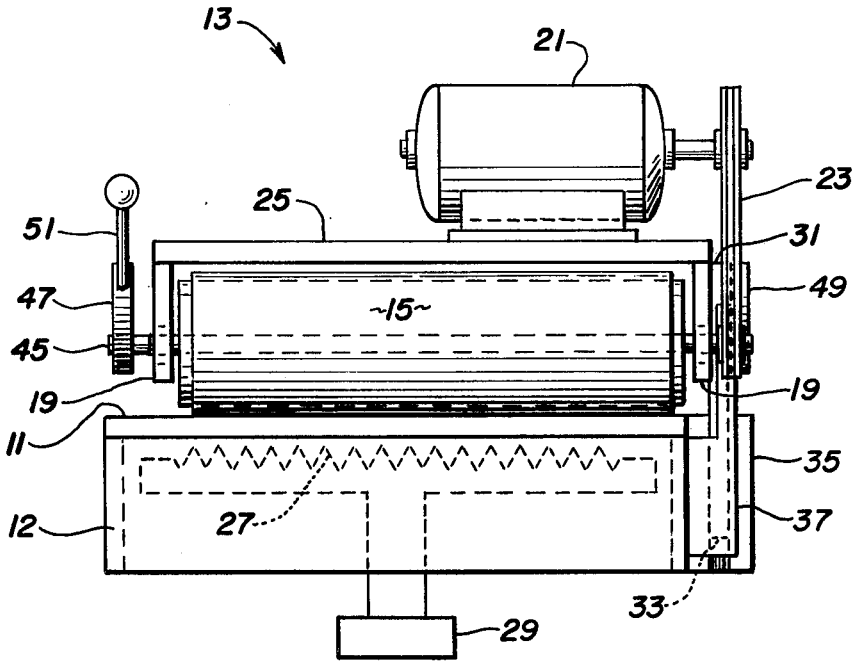
Figure 4:
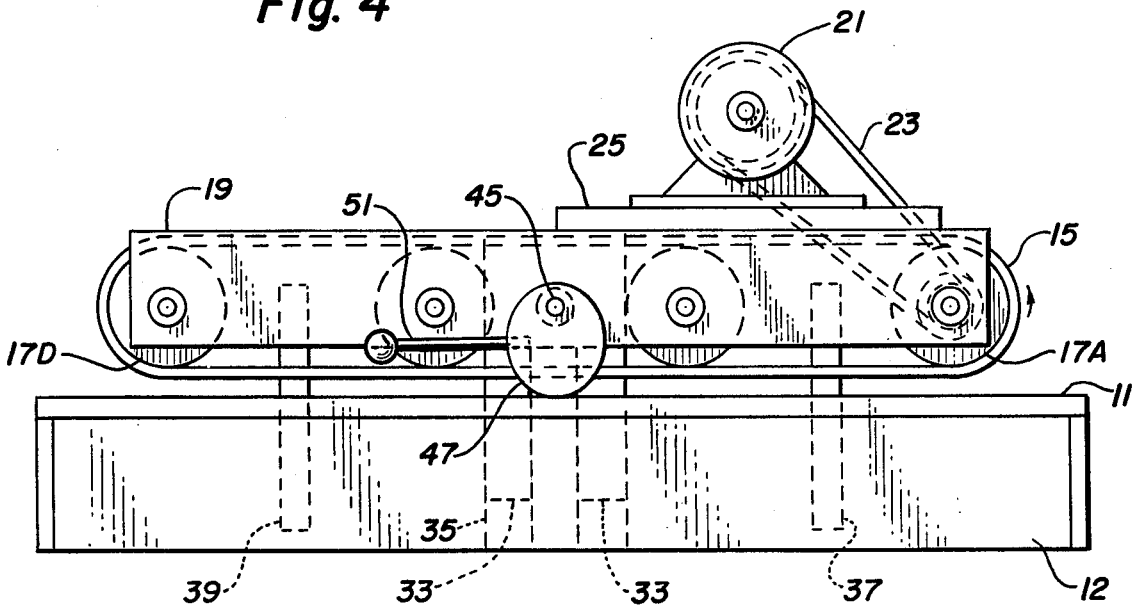
FIG. 4 is a side view of the preferred embodiment with the conveyor belt in the out-of-contact position.

When the novel machine is not being used for ironing or fusing, it is desirable to space the belt 15 from the ironing plate 11 without stopping the movement of the belt 15 and without changing the temperature of the plate 11. To this end, there is provided a shaft 45 parallel to the rollers and passing through the sides of the frame 19 between the second and third rollers 17*b* and 17*c*. Cams 47 and 49 are attached at or near the ends of the shaft 45 on each side. A lever 51 is attached to the cam 47 on the right side of the frame 11. As shown in FIGS. 1, 2 and 3, the cams and the lever 51 are in the "in-contact" position with the conveyor belt 15 lowered into contact with the ironing plate 11. As shown in FIG. 4, the cams 47 and 49 and the lever 51 have been rotated with the shaft 45 to the "out-of-contact" position with the conveyor belt 15 raised to a spaced position above and out of contact with the ironing plate 11. In this raised, "out-of-contact" position, the cams 47 and 49 engage the ironing plate 11 and supporting base 12 and the entire weight of the conveyor 13 is supported on the ironing plate 11 and base 12 through the cams 47 and 49. In the "out-of-contact" position both sides of the conveyor are obstructed. In the "in-contact" position the cams swing out of the way and, though the one side of the conveyor is obstructed by the outriggers, the yoke and the belt drive, the other side of the conveyor is completely unobstructed, and sheet materials wider than the conveyor belt 15 can extend out the side of the conveyor as they pass through the machine.

The preferred embodiment shown in FIGS. 1 to 4 shows one mechanical means for positioning the conveyor belt in-contact and out-of-contact with the ironing plate in such manner as to achieve the objects of the invention. There are other mechanical arrangements that could be used and would, in view of applicant's teaching, be obvious to persons of ordinary mechanical skill. Similar means can be provided for positioning the conveyor belt in-contact and out-of-contact with the ironing plate where the mechanical function of the cam and lever is carried out electrically as with a solenoid, or pneumatically as with a cylinder and piston, or hydraulically with a cylinder and piston.

I claim:

1. An ironing machine comprising a horizontal ironing plate, an endless-belt conveyor supported above said ironing plate, said conveyor comprising a frame, a plurality of rollers supported on said frame, a continuous belt supported on said rollers and means for driving at least one of said rollers supported on said frame, means on only one side of said conveyor for maintaining said conveyor and said ironing plate in substantially constant horizontal positions relative to one another, while permitting vertical movement of said conveyor with respect to said ironing plate, and means for positioning the endless belt of said conveyor into and out of contact with said ironing plate, said means leaving unobstructed access to the other side of said conveyor when said endless belt is positioned in contact with said plate by said positioning means.

2. The ironing machine defined in claim 1 wherein said positioning means comprises a pair of rotatable cams located one on each side of said conveyor, each cam being supported on a shaft mounted on said conveyor and means for manually rotating said cams.

3. The ironing machine defined in claim 1 wherein said positioning means is operated manually, electrically, pneumatically or hydraulically.

* * * * *